United States Patent [19]

Kawanishi et al.

[11] 4,433,042

[45] Feb. 21, 1984

[54] ELECTROPHOTOGRAPHIC DEVELOPING METHOD USING MAGNETIC TONERS

[75] Inventors: Tsuneaki Kawanishi; Akio Mukoh; Hirosada Morishita; Nobuyoshi Hoshi, all of Hitachi, Japan

[73] Assignee: Hitachi Metals, Ltd., Tokyo, Japan

[21] Appl. No.: 327,197

[22] Filed: Dec. 3, 1981

[30] Foreign Application Priority Data

Dec. 10, 1980 [JP] Japan ..... 55-173297

[51] Int. Cl.[3] ..... G03G 13/09

[52] U.S. Cl. ..... 430/126; 430/106.6; 430/109

[58] Field of Search ..... 430/109, 110, 106.6, 430/126

[56] References Cited

U.S. PATENT DOCUMENTS

| | | | |
|---|---|---|---|
| 4,210,448 | 7/1980 | Fargo | 430/122 |
| 4,218,530 | 8/1980 | Lu | 430/122 |
| 4,239,845 | 12/1980 | Tanaka et al. | 430/109 |
| 4,245,024 | 1/1981 | Yamashita et al. | 430/122 |
| 4,265,993 | 5/1981 | Kawanishi et al. | 430/109 |

*Primary Examiner*—John E. Kittle

*Assistant Examiner*—John L. Goodrow

*Attorney, Agent, or Firm*—Antonelli, Terry & Wands

[57] ABSTRACT

Electrophotographic copying is carried out by electrostatically forming a latent image on a recording medium, supplying a magnetic toner of single component system containing at least a resin and fine particles of forromagnetic material on a non-magnetic sleeve provided with a permanent magnet roller having a plurality of magnetic poles therein, transporting the magnetic toner into a gap between the recording medium and the non-magnetic sleeve, attaching the magnetic toner to the recording medium, thereby developing the latent image into a visible image, electrostatically transferring the toner image thus formed on the recording medium onto a transfer sheet, and fixing the transferred image, thereby obtaining a final image, wherein the magnetic toner has a resistivity of more than $5\times10^{15}$ Ωcm and a relative dielectric constant of less than 3.0.

Good development and good transferred image are obtained even with a recording medium having a low relative dielectric constant and a high insulating property, and practically high transfer efficiency can be obtained with the ordinary sheet having a low resistivity as a transfer sheet.

6 Claims, 4 Drawing Figures

ELECTROPHOTOGRAPHIC DEVELOPING METHOD USING MAGNETIC TONERS

BACKGROUND OF THE INVENTION

This invention relates to a method for electrophotographic copying which comprises forming an electrostatic latent image on a recording medium, developing the latent image by a single-component magnetic toner, and electrostatically transferring the developed toner image onto a transfer sheet and, more particularly, to a method for electrophotographic copying wherein a recording medium, having a low relative dielectric constant and a high insulating property such as an organic photo-conductive medium, etc. is used as the recording medium and an ordinary general purpose sheet of paper is used as the transfer sheet.

As a dry developer for developing an electrostatic latent image formed on a recording medium, a binary developer consisting of carrier particles such as iron particles or glass beads and toner particles such as color-imparting resin particles has been well known. As a method for dry-type development, a cascade method and a magnetic brush method are well known. In most of the presently available dry type copying machines, the aforementioned developing methods and developer are used to obtain copy images, where the toner and carrier particles such as iron particles or glass beads are mixed together, and these two are subjected to tribo-electric charging, and the toner is tribo-electrically charged, and electrostatically attracted to an electrostatic latent image on the recording medium to conduct development. Since the toner has a definite electrostatic charge in that system, the electrostatic latent image on the recording medium can be precisely developed. It is also possible to conduct not only normal development but also inverse development. Furthermore, the electrostaic charge of the toner is retained even after the development, and thus the toner image can be electrostatically transferred to an ordinary general-purpose sheet by corona charging of the opposite polarity. However, in order to satisfactorily conduct tribo-electric charging between the carrier particles and the toner, these two must be mixed in some definite proportions, and thus, a monitoring unit, that is, a device for the so-called toner concentration control, is required, complicating the copying system. Furthermore, as the carrier particles and toner are mixed by agitating for a long period of time, a toner film, that is, a so-called spent, is formed on the surfaces of carrier particles, reducing the tribo-electric characteristic between the toner and carrier. Therefore, the carrier particles whose life has been exhausted by the spent must be disposed as a waste.

To overcome this drawback, a method of development, where no carrier particles are used but only toner particles are brought into the vicinity of or contact with the surface of recording medium, has been proposed. In this method, ferromagnetic fine particles are contained in the toner to impart to the toner a magnetic property of sensing a magnetic field. This method is applied for use with the conventional magnetic brush development. In this case, no carrier particles are needed, and the developing mechanism can be simplified. Thus, the copying machine itself can be reduced in size. This method has been practically applied to a system, in which direct recording is made on specially treated sheets such as zinc oxide sheets or electrostatic recording sheets. The system is proposed, for instance, in U.S. Pat. No. 3,909,458, and is based on the following developing mechanism. That is, a toner containing ferromagnetic fine particles, i.e., magnetic toner, is brought to a vicinity of the surface of a recording medium to induce in the toner an electrostatic charge of the opposite polarity to the electrostatic latent image on the recording medium, whereby the electrostatic latent image can be developed by the toner due to attraction of the induced charge on the toner and the electrostatic charge on the surface of the recording medium by the electrostatic force based upon the Coulomb's force. The toner thus must have a resistivity so reduced as to readily induce the electrostatic charge in it. However, the system so far desired is not of the type of direct recording on a specially treated sheet as mentioned above, but of the type of indirect recording, that is, a system wherein a recording medium serving as a master is repeatedly used, and after the each development of recording medium, the developed toner image is transferred onto an ordinary general-purpose sheet of low electric resistance.

However, when the afore-mentioned magnetic toner for direct recording is employed in said system involving transfer, development can be satisfactorily carried out because of the low resistivity of the toner, but a is encountered in the transfer step, resulting in an unclear transfer image. Therefore, this application is not practical.

To overcome such in the transfer, attempts have been made to suitably control the resistivity of the magnetic toner. Particularly, in order to make electrostatic transfer onto the conventional transfer sheet by corona charging, several attempts have been proposed for increasing the resistivity of the magnetic toner (as disclosed in Japanese Laid-open Patent Application No. 133028/76, Japanese Laid-open Patent Application No. 51947/77, U.S. Pat. No. 4,121,431 to Nelson and U.S. Pat. No. 4,185,916 to Milton et al). The inventors also found magnetic toners, in which both development and transfer could be satisfied at the same time, by restricting relative dielectric constant of toner to an appropriate range in addition to the resistivity of toner (as disclosed in Japanese Laid-open Patent Application No. 129357/80, Japanese Laid-open Patent Application No. 129358/80, and Japanese Laid-open Patent Application No. 129356/80). These magnetic toners have a resistivity within a range between $10^9$ and $5\times10^{15}$ Ω.cm and a relative dielectric constant within a range between 2 and 5. Such a magnetic toner could make satisfactory development and transferred image which the conventional magnetic toner had not produced. However, successive extensive studies revealed that the magnetic toner can make satisfactory development and transferred image when an inorganic light-sensitive material having a high relative dielectric constant such as selenium or zinc oxide is used as the recording medium, but when a recording medium having a low relative dielectric constant and high insulating property such as an organic photo-conductive medium or Mylar as used, the transfer efficiency of toner to the ordinary sheet is reduced, so that a satisfactory transferred image cannot be obtained. Therefore, when a high insulating recording medium as mentioned above is used, it is in current practice to use a specially treated sheet having a high electric resistance as the transfer sheet to increase the transfer efficiency of the tonor. The afore-mentioned organic photo-conductive material has such merits as easy preparation, an ability to form a photo-conductive film and low cost, and has a possibility to be replaced with the conventional selenium or zinc oxide photo-sensitive material. However, a satisfactory magnetic toner for the ordinary sheet transfer, which is applicable to said organic photo-conductive material, has not yet been developed.

SUMMARY OF THE INVENTION

An object of the present invention is to provide a method for electrophotographic copying, which can overcome the afore-mentioned drawbacks inherent in the prior art and can make satisfactory development even if a recording medium having a low relative dielectric constant and a high insulating property is used.

Another object of the invention is to provide a method for electrophotographic copying, which can make satisfactory transfer even if the ordinary low resistivity sheet is used as a transfer sheet.

The present invention provides a method for electrophotographic copying method which comprises steps of electrostatistically forming a latent image on a recording medium, supplying a magnetic toner of single component system containing at least a resin and fine particles of ferromagnetic material on a non-magnetic sleeve provided with a permanent magnet roller having a plurality of magnetic poles therein, transporting the magnetic toner into a gap between the recording medium and the non-magnetic sleeve, attaching the magnetic toner to the recoding medium, thereby developing the latent image into a visible image, electrostatically transferring the toner image thus formed on the recording medium onto a transfer sheet, and fixing the transferred image, thereby obtaining a final image, wherein the magnetic toner has a resistivity of more than $5\times10^{15}$ Ω.cm and a relative dielectric constant of less than 2.6.

The invention will be described in detail below with reference to the drawings.

BRIEF DESCRIPTION OF THE DRAWINGS

In FIG. 1, a system for electrophotographic copying comprises a recording medium 1 including a recording layer 1*a* and a conductive support layer 1*b*, a corona charging unit generally designated by the reference numeral 2, an optical system generally designated by the reference numeral 3, a developing unit generally designated by the reference numeral 4, a corona transfer unit generally designated by the reference numeral 6, a fixing unit generally designated by the reference numeral 7 and a cleaning unit 8.

Figure 1:
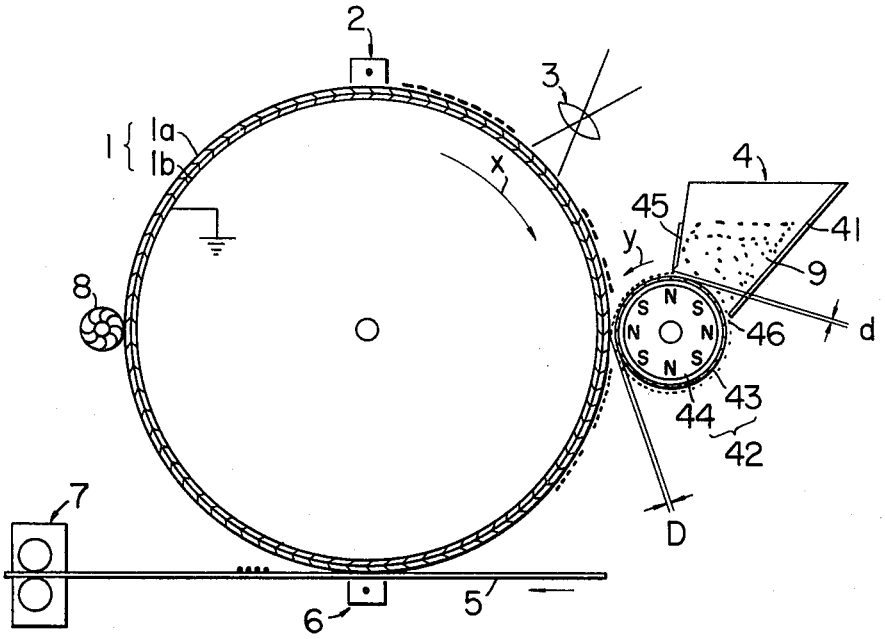
FIG. 1 is a schematic sectional view of one embodiment of a system for electrophotographic copying.

In the system, the surface of recording medium 1 rotating in the direction of arrow x in FIG. 1 is uniformly charged by corona charging unit 2 and is then exposed to light by optical system 3, whereby an electrostatic latent image is formed thereon. The electrostatic latent image is then developed by developing unit 4. Developing unit 4 is provided with a developing roller 42, which has a non-magnetic sleeve 43 disposed at a position opposite to recording medium 1 and a permanent magnet roller 44 having a plurality of magnetic poles thereon, a hopper-like toner tank 41 containing magnetic toner 9, and a doctor blade 45 for controlling the amount of toner to be supplied. In the developing unit 4, permanent magnet roller 44 and sleeve 43 are rotated relative to each other. For example, sleeve 43 may be kept stationary, whereas permanent magnet roller 44 may be rotated in the clockwise direction. Magnetic toner 9 is discharged through a doctor gap, the width of which is d and transported in the direction of arrow y in FIG. 1, whereby a magnetic brush is formed. The latent image is developed into a visible image as the surface of recording layer 1*a* is rubbed by the magnetic brush thus formed. Toner 9, after being passed through a development gap, the width of which is D, is returned through a recovery inlet 46 into the tonor tank 41. Magnetic tonor 9 thus attached to the surface of recording layer 1*a* is electrostatically transferred onto a transfer sheet 5 by corona transfer unit 6. After the transfer, the transfer sheet 5 is led to the fixing unit 7 in the direction of arrow in FIG. 1, where the transferred toner is fixed on the transfer sheet 5 to obtain a hard copy. After the transfer, the surface of recording layer 1*a* is cleaned by cleaning unit 8 to remove residual toner and is subjected to a repetition of the operation as described above.

Figure 2:
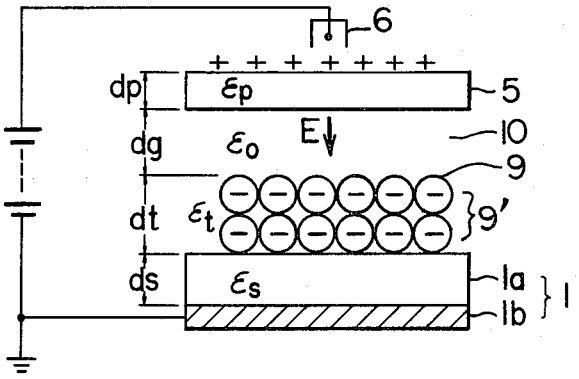
FIG. 2 is a schematic view showing a basic principle of toner transfer.

The present inventors have made theoretical analysis of transfer process in the system described above. In FIG. 2, the principles of the electrostatic transfer of toner is schematically shown. As shown in FIG. 2, the electrostatic toner transfer is a process comprising placing the transfer sheet 5 on the recording medium 1, giving a corona charge to the recording medium from the back side of transfer sheet 5 by the charging unit 6, and transferring toner 9 on the recording medium 1 electrostatically onto transfer sheet 5. Transfer is evaluated by the percentage by weight of toner 9 transferred from recording medium 1 onto the transfer sheet 5. The percentage will be hereinafter referred to as transfer efficiency. Transfer efficiency is determined by the coulomb force applied to toner 9 in the direction to transfer sheet 5 at the transfer. This coulomb force is represented by product qE of the toner charge q and electric field E in gap 10. In order to increase the transfer efficiency, it is necessary to increase toner charge q or electric field E in gap 10.

Since transfer sheet 5, gap 10, toner layer 9' and recording medium 1 shown in FIG. 2 can be regarded as equivalent to a series capacitor circuit, denoting the potential on toner layer 9' by $V_t$ and the potential on transfer sheet 5 by $V_k$, the electric field E in gap 10 will be given by the following equation;

$$E = \frac{V_k - V_t}{\frac{dp}{\epsilon_p} + \frac{dg}{\epsilon_o} + \frac{dt}{\epsilon_t} + \frac{ds}{\epsilon_s}} \quad (1)$$

where $\epsilon_p$: relative dielectric constant of transfer sheet 5,
$\epsilon_o$: relative dielectric constant of gap 10,
$\epsilon_t$: relative dielectric constant of toner layer 9' (including air),
$\epsilon_s$: relative dielectric constant of recording medium 1,
$d_p$: thickness of transfer sheet 5,
$d_g$: thickness of gap 10,
$d_t$: thickness of toner layer 9', $d_s$: thickness of recording medium 1.

Figure 3:
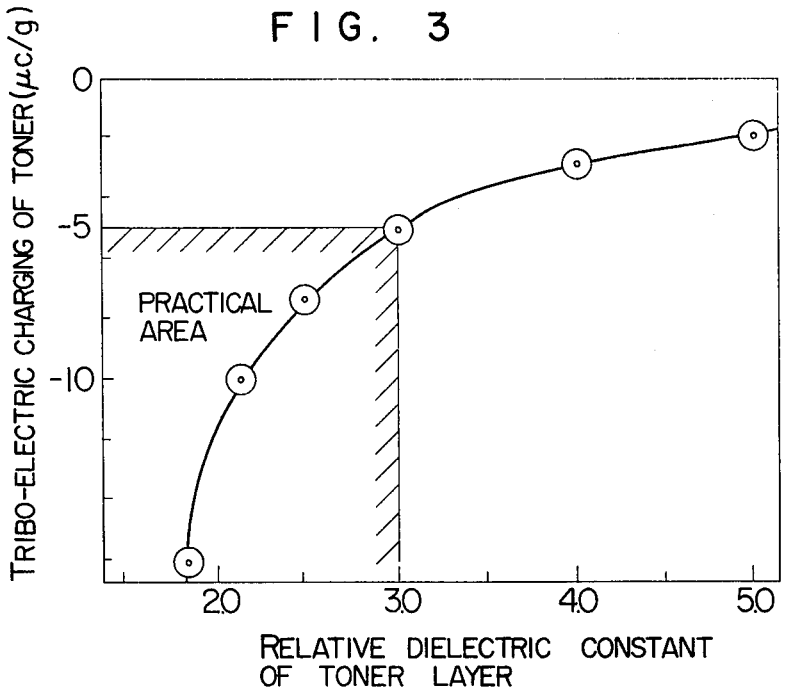
FIG. 3 is a diagram showing a relationship between the relative dielectric constant of toner layer and triboelectric charging of toner.
Figure 4:
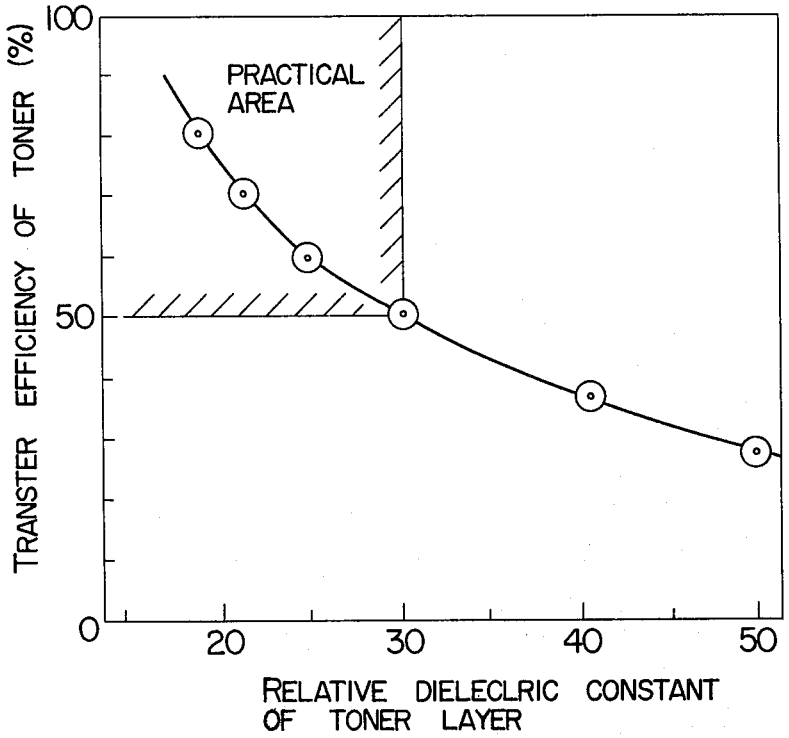
FIG. 4 is a diagram showing a relationship between relative dielectric constant of the toner layer and transfer efficiency of the toner.

Thus, electric field E of gap 10 is increased with increasing potential $V_k$ on the transfer sheet 5, with increasing relative dielectric constant $\epsilon_t$ of the toner layer 9', and with increasing relative dielectric constant $\epsilon_s$ of recording medium 1. At the actual transfer, the transfer corona charge leaks to toner 9 according to the resistance of transfer sheet 5, reducing potential $|V_k|$ of transfer sheet 5. Particularly, where an ordinary sheet having a low electric resistance is used, charge is injected into transferred toner 9 at the back side of transfer sheet 5 according to the resistivity of the tonor 9, and tonor 9 is finally charged to the same polarity as the transfer corona charge so that it is repelled by transfer sheet 5, disturbing the transfer image. In order to prevent such phenomenon, it is proposed to increase the electric resistance of transfer sheet 5, but the resistivity of the toner must be made as high as possible when an ordinary sheet having a low electric resistance is used. The present inventors have conducted extensive studies of the problem and have found that by setting the resistivity of toner 9 to be $5\times10^{15}$ Ω.cm or above, the injection of charge into toner 9 from transfer sheet 5 can be prevented to eliminate the disturbance of the transferred image. The relative dielectric constant of recording medium 1 is about 6 to 8 when the conventional selenium and zinc oxide light-sensitive media are used, but it is often less than 3 in the case of organic photoconductors or organic insulators such as Mylar. Accordingly, where an organic photo-conductor or Mylar is used, the electric field E of gap 10 is correspondingly low. Thus, it may be possible to increase relative dielectric constant $\epsilon_t$ of the toner layer 9', thereby increasing electric field E of gap 5. However, an increase in the relative dielectric constant of the toner layer 9' reduces the electric insulating property of the toner layer 9' itself, thus reducing the charge holding capacity of toner 9 and reducing tonor charge q. When the charge holding capacity is indirectly evaluated by measuring a tribo-electric charging between toner 9 and iron carrier particles as toner charge q, the relationships between tribo-electric charging q' of the tonor 9 and relative dielectric constant $\epsilon_t$ of the toner layer 9' are given in FIG. 3 for magnetic toners having a resistivity of $5\times10^{15}$ Ω.cm or more. It will be seen therefrom that the tribo-electric charging of the toner 9 is increased with reducing relative dielectric constant $\epsilon_t$ of the tonor layer 9'. Generally, in order for the tonor 9 to hold a charge, a tribo-electric charging in excess of 5 μc/g is necessary. To this end, the relative dielectric constant of the toner 9 must be not more than 3.0 as is seen from FIG. 3. Further, FIG. 4 shows the relationship between the transfer efficiency η (%) of the toner 9 from an organic photo-conductor (with a relative dielectric constant of 3.0) and relative dielectric constant $\epsilon_t$ of the toner layer, obtained with magnetic toners having a resistivity exceeding $5\times10^{15}$ Ω.cm. As seen therefrom, toners 9, the relative dielectric constant of which is less than 3.0, provide transfer efficiency above 50%, and thus it can be practically applied.

From the foregoing theoretical considerations and experimental facts, the inventors have drawn a conclusion that, where a recording medium having a low relative dielectric constant and a high insulating property is used, a magnetic toner having a resistivity greater than $5\times10^{15}$ Ω.cm and a relative dielectric constant of less than 2.6 can be effectively used to obtain a practical transfer efficiency of greater than 50% and a satisfactory transferred image with an ordinary sheet of low electric resistance. Since there is no substance whose relative dielectric constant is less than 1, the relative dielectric constant of the toner can be set between 1 and 2.6.

The present magnetic toner is attracted onto the toner support member provided on the periphery of developing roller 42, i.e., sleeve 43, to form a magnetic brush and tribo-electrically charged with relative rotation of permanent magnet roller 44 and sleeve 43, thereby satisfactorily developing the ordinary electrophotographic light-sensitive media such as selenium and zinc oxide master sheets and organic photo-conductive media and composite light-sensitive media of various multi-layers and also satisfactorily developing electrostatic recording media of organic insulating films.

According to the present invention, very pronounced effects can be obtained when an organic photo-conductive medium is developed under the following conditions. Transfer of the toner is made in the same direction as the direction of movement of the recording medium at development gap D in the case of a permanent magnet roller rotation system. If the toner is transported in the reverse direction, a toner lump is formed on the downstream side of gap D, and the toner becomes unstable at the position apart from the permanent magnet roller in the lump, resulting in possible formation of fogging. Doctor gap d is set to 0.3 to 0.5 mm when an inorganic light-sensitive medium is used, but is set to be less than 0.3 mm when an organic light-conductive medium is used. This is because if the toner layer 9' is thicker, a high developing density is obtained, but the residual potential is high, with the result that the amount of toner 9 to be attached to the non-image portion is increased to greatly reduce the transfer efficiency onto the ordinary sheet. That is, there is such a problem that the density is reduced.

It has been experimentally confirmed that the sheet fogging can be reduced with narrower development gap D. Thus, the range for doctor gap d should be set as defined above also from the standpoint of stabilized development for a long time by reducing gap D.

In order to conduct satisfactory development by narrowing doctor gap d, the magnetic brush should be in soft and complete contact with the surface of recording medium. To this end, the permanent magnet roller 44 is made to rotate at a high speed of about 290 mm/sec, or higher, or the sleeve 43 is made to rotate in the same direction as that of permanent magnet roller 44 but at a lower speed, for instance, about one-third of the speed of the permanent magnet roller 44. Under this condition, the toner 9 on the sleeve 43 is transported mainly by its own rotating force, and thus soft contact between the toner 9 and the recording medium 1 can be established. Also, sufficient contact can be obtained because of a low transport speed of the toner 9. However, if the peripheral speed of the permanent magnet roller 44 is excessively high, scattering of the toner 9 or cleaning effect of the magnetic brush is increased, and therefore, the peripheral speed is preferably not more than about 1,000 mm/sec. If development gap D is too small in the toner transport system as mentioned above, a toner pool formed on the upstream side of the development gap is liable to become larger, changing the width of contact between the toner and the recording medium 1. On the other hand, if gap D is too wide, sufficient contact between the toner and the recording medium 1 cannot be obtained, reducing the density.

Thus, a preferable range for gap width D is $d \leqq D \leqq d+0.1$ (where d is the width of gap d).

Satisfactory development can be obtained even by holding the permanent magnet roller 44 stationary while rotating only the sleeve 43, but in this case, the positions of the developing magnetic poles should be carefully located to ensure that the magnetic brush and the light-sensitive medium can be brought in soft contact with each other.

Since the toner is still charged after the development, satisfactory transfer of the toner image onto a transfer sheet 5 can be obtained by placing a transfer sheet 5 on the toner image and applying an electric field to the transfer sheet 5. Particularly, the present magnetic toner has such features that the transfer efficiency is not influenced by the electric insulating property, i.e., relative dielectric constant or electric resistance, of a recording medium 1 or a transfer sheet 5, so that it can be electrostatically transferred from organic photoconductive media of low relative dielectric constant and organic insulating recording media, in which the transfer has hitherto been difficult to conduct, onto ordinary sheets of low electric resistance with a bulk resistivity of not higher than $10^{12}$ Ω.cm.

The present magnetic toner is prepared in the following manner.

Fine ferromagnetic particles, a fixing resin, a color-controlling pigment or dye or a charge-controlling agent are premixed in a mixer such as a ball mill or a super-mixer, then kneaded in a molten state in a kneader such as a double roll kneader, and disintegrated into fine particles after cooling, and classification. The resulting fine particles of the magnetic toner can be used as such, but in order to improve the flowability of the toner 9, it is effective to allow the fine particles fall through a heating oven to make the toner particles spherical.

Various materials applicable to preparation of the ordinary magnetic toner can be used as the materials for the present toner. That is, the effective fine ferromagnetic particles include those of materials capable of causing very strong magnetization in the direction of applied magnetic field, such as alloys or compounds containing ferromagnetic elements, for example, iron, cobalt, nickel, etc., including ferrite and magnetite, or various other alloys showing a ferromagnetic property by some treatment such as heat treatment. For these fine ferromagnetic particles to be contained in the toner, it is desirable that they have an average particle size of 0.1–3 μm. Desirable amount of the fine ferromagnetic particles in the toner is 5–60% by weight. Below 5% by weight, the magnetic force of the toner 9 is lowered, and the toner 9 is released from the permanent magnet developing roller, disturbing the image. Above 60% by weight, the conductivity of the toner 9 is liable to increase, because generally the fine ferromagnetic particles have a conductivity, and consequently the transfer efficiency is lowered and the image is disturbed. Thus, if a relatively larger amount of the fine ferromagnetic particles is used even within the afore-mentioned range, for example in an amount of more than 40% by weight, it is desirable to coat the surface of the fine ferromagnetic particles with a resin, a higher fatty acid, or an organometallic compound in advance.

The fixing resin must be properly selected in view of a fixing system. For example, when fixation is carried out by heating in an oven or by heat rollers, such thermoplastic resin is used, as homopolymers prepared by polymerization of monomers of styrenes, vinyl esters, esters of α-methylene aliphatic monocarboxylic acids, acrylonitrile, methacrylonitrite, acrylamide, vinyl ethers, vinyl ketones, N-vinyl compounds, etc. or copolymers prepared by polymerization of a combination of at least two of these monomers, or their mixture. Furthermore, non-vinylic resins such as non-vinylic thermoplastic resins, for example, rosin-modified phenol-formalin resin, bisphenol-type epoxy resin, oil-modified epoxy resin, polyurethane resin, cellulose resin, polyether resin, polyester resin, etc. or mixtures of these nonvinylic resin with the afore-mentioned vinyl resins can be used in the present invention.

Particularly, when the developed toner image is fixed by heating in an oven, the bisphenol-type resin is preferable. When fixation is made by heat rollers, the resin containing the styrene resin as the major component or polyester resin is preferable. The styrene resin having a higher styrene content has an improved releasability for the heat rollers. To further improve the releasability for the heat rollers, it is effective to add metal salts of fatty acids, low molecular weight polyethylene or polypropylene, higher fatty acids having 28 or more of carbon atoms, natural or synthetic paraffins to the resin.

On the other hand, when fixation is carried out by pressing, for example, by pressure rollers, such pressure-sensitive resins are used as higher fatty acids, metal salts of higher fatty acids, higher fatty acid derivative, higher fatty acid amides, waxes, rosin derivatives, alkyd resin, epoxy-modified phenol resin, natural resin-modified phenol resin, amino resin, silicone resin, polyurethane, urea resin, polyester resin, copolymerization oligomers of acrylic acid or methacrylic acid and long chain alkyl methacrylate, or long chain alkyl acrylate, copolymerization oligomers of styrene and long chain alkyl acrylate or long chain alkyl methacrylate, polyolefins, copolymer of ethylene and vinyl acetate, copolymers of ethylene and vinyl alkyl ether, maleic anhydride copolymers, petroleum residues, rubbers, etc.

The resins can be selected as desired, and used in a mixture as desired, but in order not to lower the flowability of the resulting toner, it is effective to use the resin having a glass transition point of more than 40° C., or a mixture containing such resins.

The amount of the fixing resin for the toner is a balance from the total of the fine ferromagnetic particles, the color-controlling pigment or dye, and the charge-controlling agent, but in order not to lower the fixability of the toner, at least 30% by weight of the fixing resin should be used on the basis of the entire tonor.

Various color-controlling pigments or dyes so far used in the ordinary dry developing agent can be used as desired, but should be used in such an amount as not to lower the electric characteristics of the toner. In the present invention, it is appropriate to use less than 10% by weight of color-controlling pigment or dye on the basis of the entire toner. The color-controlling pigment or dye includes, for example, carbon black, Nigrosine dye, anilin blue, calco oil blue, chrome yellow, ultramarine blue, DuPont oil red, quinoline yellow, methylene blue chloride, phthalocyanine blue, Malachite green oxalate, lamp black, Rose Bengal, and their mixture. Since the fine ferromagnetic particles themselves are colored, it is not always to add the color-controlling agent thereto.

In the case of carbon black, which is conductive particles, it is necessary to add 0.5–1 part by weight of carbon black to 100 parts by weight of the resin component of the toner so as not to lower the electric insulating property of the toner. Carbon black has various functional groups depending on its process, and thus has a charge controlling property by itself, which can be effectively utilized.

Specific pigment or dye can be selected for use in a combination with the fine ferromagnetic particles and the fixing resin to control the tribo-electric charging on the surface of the sleeve 43 or recording medium 1 on the toner developing roller. However, the well known dye or pigment can be further added as a charge-controlling agent to control the charging of toner. For example, Nigrosine dye having a positive tribo-electrical chargeability, Nigrosine dye modified by higher fatty acid, and azo dye containing a metal, for example, Cr, and having a negative tribo-electrical chargeability can be used. Some polymeric dye has more stable charge than the aforementioned dyes, as disclosed in Japanese Patent Publications Nos. 28232/76, 13284/78, etc. and is particularly effectively used in the magnetic toner. Furthermore, oxidation-treated carbon black, resins having positive or negative charge-controllable groups, etc. can be regarded as a kind of the charge-controlling agent, and can be effectively used.

The toner comprising the afore-mentioned materials in the afore-mentioned composition is disintegrated to particles, classified or made into spheres after the disintegration and classified, and used. Classification is carried out, for example, in a zigzag classifier preferably to limit an average particle size of the toner particles to 3–30 μm. When there are a large amount of particles having an average particle size of less than 3 μm, a higher image density can be obtained with much fogging, whereas, when there are a larger amount of particles having an average particle size of more than 30 μm, occurrence of the fogging can be reduced, but the image density is lowered, and a rough image is liable to be obtained.

The classified toner particles can be admixed with various ordinary additives for toner to adjust the electric insulating property and flowability of the toner, but the electrical characteristics of the toner must be kept within the range described before even by addition of the additives.

Various inorganic and organic additives can be used, but additives having an average particle size of 0.01–500 μm and the effect when added in an amount of 0.01–4% by weight on the basis of the entire toner, are preferable. When additives that fail to fall in the above-mentioned ranges are added to the toner, no satisfactory transferred image is obtained, because the electrical insulating property of the toner generally fails to fall in the slope of the present invention.

The additives for the present invention include fine silica powder such as aerosil, etc., carbon black, various dyes and pigments, and fine resin powders, such as fine polytetrafluoroethylene or polystyrene powders, among which aerosil and carbon black are effective, and addition of 0.05–2% by weight of aerosil or 0.05–0.2% by weight of carbon black to the toner on the basis of the entire toner can improve the electric insulating property and flowability of the toner. That is, these two have a remarkable effect upon improvement of development and transfer of the toner.

The ordinary electrophotographic photoconductor, and electrostatic recording medium can be used for the present magnetic toner, as described above, and it is particularly charactersitic of the present invention that an organic photoconductor and an organic insulating film can be used as the recording medium 1. The organic photoconductor includes, for example, polyvinylcarbazole, 4-dimethylaminobenzylidene, benzyhydrazide, 2-benzyldeneaminocarbazole, 4-dimethylaminobenzylidene, polyvinylcarbazole, (2-nitrobenzylidene)-p-bromoaniline, 2,4-diphenylquinazoline, 1,2,4-triazine, 1,5-diphenyl-3-methylpyrazoline, 2-(4'-dimethylaminophenyl)-benzoxazole, 3-aminocarbazole, polyvinylcarbazole-trinitrofluorenone charge transport complex, phthalocyanine and their mixtures.

The electric characteristics of the present magnetic toner depend upon materials and compositions of toner and process for preparing toner. The resistivity and the relative dielectric constant are measured in the following manner.

The resistivity is obtained by weighing out an appropriate amount, for example, about 10 mg, of a magnetic toner, placing it into an insulating cylinder of polyacetal having a diameter of 3.05 mm and a cross-sectional area of 0.073 $cm^2$, which is a remodeling of an old dial gage, measuring the resistance of the toner under a load of 0.1 kg weight in a direct current electrical field of 4,000 $V.cm^{-1}$, and calculating the resistivity therefrom. An insulation resistance tester type 4329A made by Yokokawa-Hurret-Packard K.K., Japan is used. On the other hand, the relative dielectric constant is measured by means of a Q meter. That is, a cylindrical cell having an inner diameter of 42 mm, whose bottom surface is coated with a conductor to work as an electrode, and whose side surface is coated with a polyacetal insulating material having a thickness of 3 mm and a height of 5 mm, is used, and 3–5 g of a magnetic tonor is weighed out and placed between two counterposed disk electrodes of Q meter to measure the relative dielectric constant of the toner at a frequency of 100 kHz. Q meter is of type QM-102A made by Yokogawa Denki K.K., Japan.

To investigate the charge holdability of the magnetic toner, a tribo-electric charging between a magnetic toner and iron carrier particles is measured in the following manner. 0.5 g of a magnetic toner is thoroughly admixed with 10 g of carrier of binary developing agent, and 0.2 g of the resulting mixture is weighed out, and a tribo-electric charging of the magnetic tonor against the carrier is measured under a blow pressure of 1.0 $kg/cm^2$ for a blow-off time of 40 sec by a blow-off tribo-electric charging tester for particles, type TB-200, made by Toshiba Chemical K.K., Japan. The toner having a high tribo-electric charging can be considered to have a good charge holdability and good development and transfer efficiencies.

The present invention will be described in detail below, referring to Examples, which will not be limitative of the present invention.

EXAMPLE 1

68 parts by weight of polyester resin having a softening point of 121° C. as a fixing resin (type PS#2 made by Hitachi Kasei K.K., Japan), 2 parts by weight of fatty acid-modified Nigrosine dye as a positive charge-controlling agent (type Bontron N-01, made by Orient Kagaku K.K., Japan) and 30 parts by weight of magnetite as fine ferromagnetic particles (type KN-320, made by Toda Kogyo K.K., Japan), and dry-premixed in a supermixer for 5 minutes. Then, the resulting mixture was kneaded in a molten state in a kneader heated at 110°–120° C. The kneaded mixture was pulverized into particles in a jet mill after cooling, and the resulting particles were classified in a zigzag classifier to eliminate the particles having the particle sizes of less than 3 μm and more than 30 μm. Then, the classified spherical toner was admixed with 0.1% by weight of carbon black (made by Mitsubishi Kasei Kogyo K.K., Japan) on the basis of the toner to prepare magnetic toner.

The electrical characteristics of the thus prepared magnetic toner were measured according to the aforementioned procedures, and it was found that the resistivity was $7\times10^{15}$ Ω.cm under an electric field of DC 4,000 $V.cm^{-1}$, and the relative dielectric constant was 2.6 at the frequency of 100 kHz.

Then, the toner was made to attach to a developing roller to evaluate tonor images. As the developing roller, a magnet roller having an outer diameter of 29.3 mm and having 8 magnetic poles in a stainless steel shell having an outer diameter of 31.4 mm and a magnetic flux density of 800 G on a sleeve, made by Hitachi Metals, Ltd., Japan was provided at the developing section of a copying machine (type P-500 made by Richo Company, Ltd., Japan) with a doctor gap d of 0.3 mm and a distance D of 0.3 mm between the photo-sensitized medium and the sleeve of developing machine. The developing roller and the sleeve 43 were rotated in the direction opposite to the moving direction of the photo-sensitized medium at 1,200 rpm and 20 rpm, respectively, to develop the electrostatic latent image on the photo-sensitive medium. As the photo-sensitized medium, an organic photo-conductor consisting of two layers, i.e. a charge-generating layer and a charge transport layer, for type P-500 was used after charging to ⊖600 V. After the development, the ordinary sheet having a volume resistivity of less than $10^{12}$ Ω.cm was used as a transfer sheet to electrostatitically transfer the magnetic toner and prepare the transferred image of the magnetic toner. The transferred image was fixed by heat rollers i.e. silicon rubber rollers impregnated with silicone oil, for the copying machine, heated to 160°–180° C. Development of the sensitized medium by the magnetic toner and transfer of the toner to the transfer sheet 5 could be carried out satisfactorily, and fixation of the transferred image by heat rollers could be also attained with a satisfactory result. Thus, a copied image equivalent or superior to that of the conventional binary tonor could be obtained.

EXAMPLE 2

20 parts by weight of bisphenol type epoxy resin having a softening point of 80° C. (Epikote #1002 made by Shell Chemical Co., USA), 48 parts by weight of bisphernol type epoxy resin having a softening point of 1,000° C. (Epikote #1004, made by Shell Chemical Co., USA) as fixing resins, 2 parts by weight of fatty acid-modified Nigrosine dye as a positive charge-controlling agent (Bontron N-03, made by Orient Kagaku K.K., Japan) and 30 parts by weight of ferrite particles as fine ferromagnetic particles ($\alpha$-$Fe_2O_3$ made by Hitachi Metals, Ltd., Japan) were weighed out, and a magnetic toner was prepared therefrom in the same manner as in Example 1. Electrical characteristics of the resulting toner were measured in the afore-mentioned manner, and it was found that the resistivity was $1\times10^{16}$ Ω.cm and the relative dielectric constant was 2.1.

The resulting toner was evaluated in the same manner as in Example 1, and it was found that good transferred image was obtained and satisfactory fixation of the transferred image could be attained by an oven-type fixing machine heated to 150° C.

EXAMPLE 3

60 parts by weight of polyethylene wax having a softening point of 128° C. (Hiwax 200P, made by Mitsui Petrochemical Co., Ltd., Japan), 8 parts by weight of ethylene-vinyl acetate copolymer having a softening point of 95° C. (ACP 400 made by Allied Chemical Corporation, USA) as fixing resins, 2 parts by weight of polymeric dye based on piperazine as the main constituent as a positive charge-controlling agent (AFP-B made by Orient Kagaku K.K., Japan), and 20 parts by weight of magnetite (CKN-320 made by Toda Kogyo K.K., Japan) and 10 parts by weight of magnetite (CJ-3000B made by Kanto Denka Kogyo K.K., Japan) as fine ferromagnetic particles were weighed out, and a magnetic tonor was prepared in the same manner as in Example 1. Electrical characteristics of the thus prepared toner were measured in the afore-mentioned manner, and it was found that the resistivity was $3\times10^{16}$ Ω.cm and the relative dielectric constant was 1.9.

The toner was then evaluated in the same manner as in Example 1, and it was found that a good transferred image was obtained, and fixation of the image could be satisfactorily attained by pressure rollers under the line pressure of 30 Kgf/cm.

EXAMPLE 4

60 parts by weight of styrene-butadiene copolymer having a softening point of 160° C. (Plyolite S-5B made by Goodyear Tire & Rubber Co., USA) and 8 parts by weight of low molecular polyethylene having a softening point of 105° C. (151P made by Sanyo Kasei K.K., Japan) as fixing resins, 2 parts by weight of Cr-containing azo dye as a negative charge-controlling agent (S-31 made by Orient Kagaku, K.K., Japan), and 30 parts by weight of magnetite as fine ferromagnetic particles (RN-320, made by Toda Kogyo K.K., Japan) were weighed out, and a magnetic toner was prepared in the same manner as in Example 1, except that the kneading temperature of the kneader was elevated to 150°–160° C.

Electrical characteristics of the thus prepared toner were measured in the afore-mentioned manner, and it was found that the resistivity was $10^{15}$ Ω.cm and the relative dielectric constant was 2.3.

As a photo-sensitive medium, a double layer-type, organic photo-conductor consisting of a charge-generating layer of ε-copper phthalocyanine (Lyonoble-ESP, made by Toyo Ink K.K., Japan) and an charge transport layer prepared by mixing poly-N-vinylcarbazole (Tsubicol 210 made by Anami Sangyo K.K., Japan), 2,4,7-trinitrofluorenone (made by Tokyo Kasei K.K., Japan) and polyester resin (Pyron 200 made by Toyo Boseki K.K., Japan) in ratio by weight of 1:0.6:0.04 was provided on a copying machine (P-500, made by Ricoh Company, Ltd., Japan), and charged to ⊕500 V. Image was prepared in the same manner as in Example 1.

It was found that development of photo-sensitized medium by the magnetic toner and transfer of toner to transfer sheets could be carried out satisfactorily, and good fixation of the transferred image could be attained by heat rollers, i.e. teflon rollers not coated with siicone oil. Copied image equivalent or superior to that of the conventional binary toner could be obtained.

EXAMPLE 5

A magnetic toner was prepared in the same manner as in Example 4, except that 1.5 parts by weight of polymeric dye (E-81, made by Orient Kagaku K.K., Japan) and 0.5 parts by weight of carbon brack having pH 3.0 (MA-100, made by Mitsubishi Kasei Kogyo K.K., Japan) were used in place of the negative charge-controlling agent S-31. Electrical characteristics of the thus prepared toner were measured in the afore-mentioned manner, and it was found that the resistivity was $6\times10^{15}$ Ω.cm and the relative dielectric constant was 2.2.

Electrostatic image was made in the same manner as in Example 4 with the organic photoconductor having the same structure as in Example 4 as a photosensitive medium. Good transferred image was obtained, and good fixation of the transferred image could be attained by heat rollers, teflon rollers not coated with silicone oil.

EXAMPLE 6

A magnetic toner of pressure fixation type containing a positive charge-controlling agent as in Example 3 was used in a copying machine (P-500, made by Ricoh Company, Ltd., Japan) provided with the same organic photo-conductor as in Example 4, and letter patterns were divisionally exposed to the photo-conductor by a semiconductor laser (HC-1400, oscillation wave length: 807 mm, output 3 mW, made by Hitachi, Ltd., Japan), and a bias potential of 1,000 V was applied to between the photosensitized medium and the sleeve of the developing machine while making the sleeve side positive, and image was made by the reversing development in the same manner as in Example 1. Then, a transfer sheet was placed on the image, and the toner was electrostatistically transferred onto the transfer sheet. Good transferred image was obtained, and could be fixed satisfactorily by pressure rollers under line pressure of 30 Kgf/cm.

As described above, the following effects can be obtained in the present invention.

(1) Since a magnetic toner having specific ranges of resistivity and relative dielectric constant is used, good development and good transferred image can be obtained even with a recording medium having a low relative dielectric constant and a high insulating property.

(2) Practically high transfer efficiency can be obtained with the ordinary sheet having a low resistivity as a transfer sheet.

What is claimed is:

1. A method for electrophotographic developing, the method comprising the steps of electrostatically forming a latent image on an organic photoconductive member, supplying a single component magnetic toner containing at least a resin and find particles of ferromagnetic material on a non-magnetic sleeve provided with a permanent magnetic means having a plurality of magnetic poles therein, the magnetic toner having a resistivity of more than $5\times10^{15}$ Ω.cm and a relative dielectric constant of less than 2.6, transporting the magnetic toner into a gap between the organic photoconductive member and the non-magnetic sleeve, attaching the magnetic toner to the organic photoconductive member, thereby developing the latent image into a visible image, electrostatically transferring the toner image thus formed on the organic photoconductive member onto a transfer sheet of ordinary paper having a low electric resistance with a bulk resistivity of not greater than $10^{12}$ Ω.cm, and fixing the transferred image, thereby obtaining a final image.

2. The method according to claim 1, wherein the magnetic toner contains 5 to 60% by weight of fine ferromagnetic particles on the basis of the toner, a fixing resin, color-controlling pigment or dye and a charge-controlling agent and an average particle size of the magnetic toner is in a range of 3–30 μm.

3. The method according to claim 2, wherein the magnetic toner particles are mixed with inorganic or organic particles with an average particle diameter ranging from 0.01 to 500 microns as a resistance and flowability-adjusting agent in an amount of 0.01 to 4% by weight on the basis of the all toner particles.

4. The method according to claim 3, wherein the magnetic toner particles are mixed with at least carbon black as a resistance and flowability-adjusting agent in an amount of 0.05 to 0.2% by weight on the basis of the all toner particles.

5. The method according to claim 1, further comprising the steps of adjusting a width of the gap between the organic photoconductive member and non-magnetic sleeve and a width of a doctor gap between the non-magnetic sleeve and supply of magnetic toner such that a width D of the gap between the organic photoconductive member and non-magnetic sleeve is in the range of $d \leqq D \leqq d+0.1$, wherein d is a width of the doctor gap.

6. The method according to claim 6, wherein the step of transporting the magnetic toner includes rotating the non-magnetic sleeve in the same direction as the permanent magnetic means at a speed of about one-third a rotational speed of the permanent magentic means.

* * * * *